US005870864A

United States Patent [19]

Snyder et al.

[11] Patent Number: 5,870,864

[45] Date of Patent: Feb. 16, 1999

[54] WATER COLLECTION PAN FOR UNIT MASONRY WALL SYSTEMS AND DRAINAGE SYSTEM INCORPORATING SAME

[76] Inventors: Jeffrey Thomas Snyder, 508 Gardner, Northville, Mich. 48167; Jerald Allen Snyder, 7796 Thunder Bay, Pinckney, Mich. 48169

[21] Appl. No.: 741,029

[22] Filed: Oct. 30, 1996

[51] Int. Cl.[6] ..... E02D 19/00

[52] U.S. Cl. ..... 52/169.5; 52/302.1; 52/302.4

[58] Field of Search ..... 52/169.5, 302.1, 52/302.3, 302.4, 302.6, 310, 503, 504, 505, 604, 606, 98, 421; 405/36, 43, 45, 47, 48, 229

[56] References Cited

U.S. PATENT DOCUMENTS

| | | | |
|---|---|---|---|
| 835,669 | 11/1906 | Eckley | 52/302.4 |
| 1,746,816 | 2/1930 | Boes | 52/302.4 X |
| 2,657,570 | 11/1953 | Moore | 52/302.6 X |
| 2,934,931 | 5/1960 | Johnson | 52/302.6 X |
| 3,293,810 | 12/1966 | Cox et al. | 52/302.6 |
| 3,429,084 | 2/1969 | Brewer | 52/302.1 X |
| 3,668,829 | 6/1972 | Nelson | 52/302.3 |
| 4,253,285 | 3/1981 | Enright | 52/302.3 |
| 4,272,931 | 6/1981 | Stanizzo | 52/98 |
| 4,375,143 | 3/1983 | Godlewski | 52/421 X |
| 4,612,742 | 9/1986 | Bevilacqua . | |
| 4,907,385 | 3/1990 | Biodrowski . | |
| 4,910,931 | 3/1990 | Pardue, Jr. . | |
| 5,115,614 | 5/1992 | McGrath . | |
| 5,120,162 | 6/1992 | Parker . | |
| 5,274,968 | 1/1994 | Pardo | 52/302.3 X |
| 5,596,857 | 1/1997 | Besche | 52/421 |

*Primary Examiner*—Carl D. Friedman
*Assistant Examiner*—Kevin D. Wilkens
*Attorney, Agent, or Firm*—Brooks & Kushman

[57] ABSTRACT

A drainage system includes a plurality of water collection pans which may be quickly inserted in the interior cavities of masonry block units over the length of a selected block wall course for collecting the water drained through the interior cavities of the upper courses and directing water to the exterior of the wall. In one embodiment, the collection pans (utilized for units such as bond beam, lintel, or knock-out blocks) includes a collector portion for positioning in the interior cavity of the block and extending across substantially the entire length of the block, the front and rear edges of the collector portion each including a flange extending generally horizontally to contact the top surface of the block, and a drainage channel extending outward from the collector portion past the endwall of the block into the head joint between the block and an adjacent block. Another embodiment of the collection pan designed for use with conventional C.M.U.'s includes a collector portion for positioning in the interior vertical cavity of the block, each of the front and rear edges including a flange extending generally horizontally from the edge to contact the top surface of the block, and a drainage channel extending downward from an opening in the collector portion through the interior vertical cavity toward the front wall of the block and extending below the block so that the end of the drainage channel may be positioned in the bed joint below the block.

29 Claims, 14 Drawing Sheets

Fig. 2
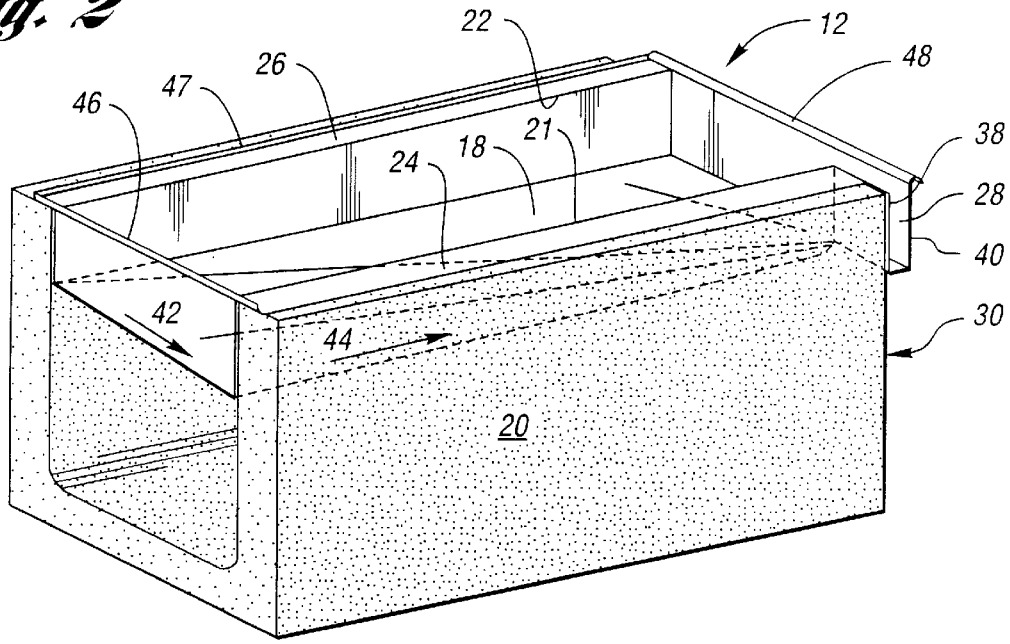
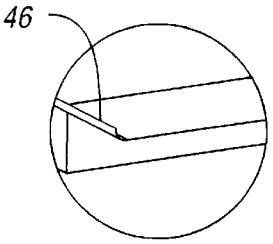
Fig. 3
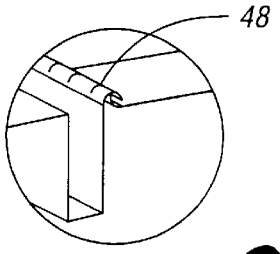
Fig. 4
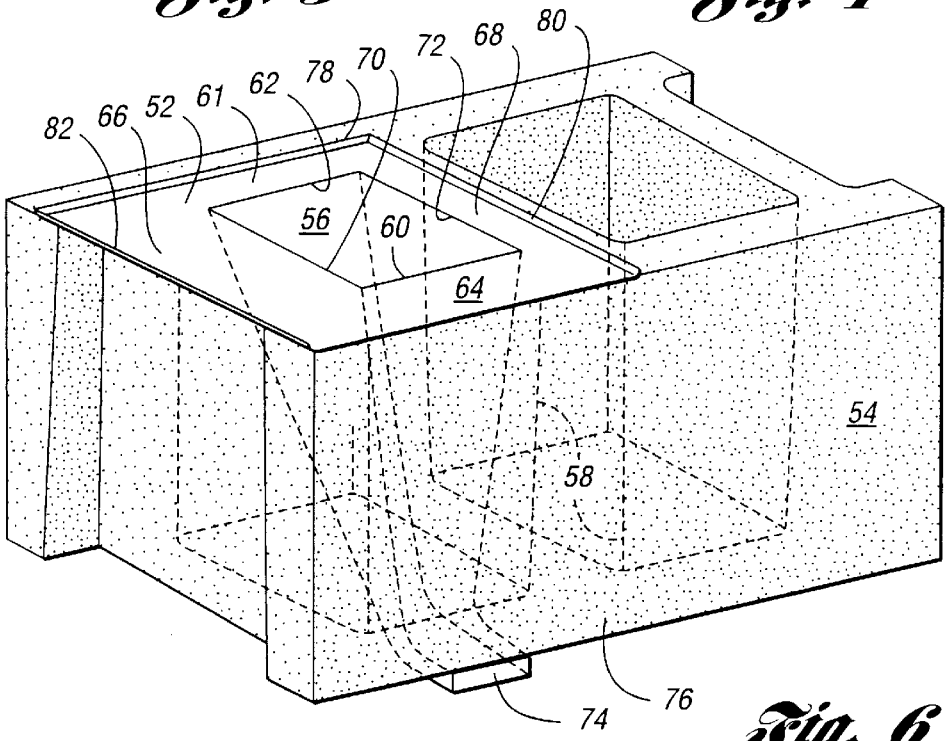
Fig. 6

WATER COLLECTION PAN FOR UNIT MASONRY WALL SYSTEMS AND DRAINAGE SYSTEM INCORPORATING SAME

TECHNICAL FIELD

This invention relates to a water collection pan adapted for installation in unit masonry wall systems, as well as a drainage system employing a plurality of the collection pans.

BACKGROUND OF THE INVENTION

One of the most common and versatile methods of building construction employs concrete masonry. Concrete masonry units (C.M.U.) are manufactured in various sizes, shapes, colors, and surface finishes for use in a wide variety of applications. The most common C.M.U. shapes include standard (or stretcher) units, open-ended (including bond beam, lintel, and knock-out) units, as well as single and double open-end units. The C.M.U.'s come in a number of relatively standard dimensions. Typical sizes and shapes of C.M.U.'s are illustrated in National Concrete Masonry Association (NCMA) Technical Bulletin No. TEK 2-1A (1995), the disclosure of which is incorporated herein by reference.

Other types of units besides C.M.U.'s are also commonly employed in constructing unit masonry wall systems. These include bricks (and other clay or shale units), structural tile, glass units, stone, and pre-cast stone. As used hereinafter, "unit", "masonry unit," or "block" is intended to include any construction unit utilized in building unit masonry wall systems including those units described above.

Different sized, shaped and types of masonry units are often utilized in combination. The units are typically laid up with mortar and, optionally, with steel reinforcement, grout, and other accessories to form unit masonry wall systems of enumerable variety in size and shape. The units each often have one or more vertically extending interior cavities hereinafter referred to as "cores" so that, when multiple courses of the blocks are assembled to form a wall, the cores of the blocks are aligned to form unobstructed, continuous series of vertical spaces within the wall. Basic unit masonry wall system designs include single wythe, multiple wythe (such as cavity wall systems), and veneer systems.

A persistent problem in the design and construction of concrete unit masonry wall systems is the migration of water from the exterior of the block walls to the interior of the building. Designers and builders have tried various methods and apparatus to intercept the flow of water through masonry, direct it to the exterior of the structure, and to prevent the upward migration of water from below grade level. One accepted approach is to install flashing at any location in block walls where the potential exists for water penetration, such as the top of walls at copings, at the base of parapets, over openings, beneath sills, over bond beams, at shelf angles, at the tops of foundations, and in walls at ground level to serve as a water stop. The installation of flashing is, however, labor intensive, and therefore costly. In particular, conventional flashing is difficult and time consuming to properly install in block courses including rebar or other vertical reinforcement. Moreover, conventional flashing has limited effectiveness in single wythe wall systems since the flashing cannot be installed to slope toward the weep holes in the blocks. In addition, conventional flashing is difficult to inspect since, once installed, flashing may not be evident from the exterior of the wall.

U.S. Pat. No. 5,115,614, issued to McGrath, discloses an integral flashing unit comprising a custom designed masonry block which includes a solid base and integral weep slot for collecting and directing water from the interior cavities of blocks installed in courses above the flashing unit and directing the water to the exterior of the wall. One drawback of the above-mentioned system is that it requires fabrication and shipment of a separate set of non-standard blocks for each construction job. Moreover, the nationwide acceptance and use of such specialty units is inhibited by the high costs of shipping the custom-made blocks.

U.S. Pat. No. 4,910,931, issued to Pardue, Jr., discloses a water collection and drainage system which includes a system of upper water collection pans suitable for installation in upper bond beam courses, which pans collect and direct the water through the vertical block cavities and lower block courses to another series of collection pans at a lower beam block course, which in turn direct the water to base collection pans at the lower most beam block course where the water is directed to the exterior of the wall through weeping spouts. Drawbacks to this system include the cost and complexity of installation of the multiple tiers of collection pans, as well as design limitations in the system which require installation solely in bond beam courses.

An object of the present invention, therefore, is to provide an effective drainage system for unit masonry wall systems which can be fabricated, shipped to construction sites, and installed at a low cost.

Another object of the present invention is to provide a drainage system for unit masonry wall systems which can be installed in any of a variety of standard masonry block units, including bond beam units, knock-out units, and standard two-core and three-core units.

Another object of the present invention is to provide a drainage system including water collection pans which can be quickly installed in any of a variety of standard masonry units to implement a drainage system for single wythe or cavity wall systems, as well as for masonry veneer systems.

Yet another object of the present invention is to provide water collection pans which may be quickly and easily installed at various locations in unit masonry wall systems to effect drainage of collected water to the exterior of the walls.

Another object of the present invention is to provide a drainage system including water collection pans which can be installed and utilized below grade to provide effective collection and diversion (to either the interior or the exterior) from basement walls.

Another object of the present invention is to provide a drainage system including water collection pans which can be installed to provide effective collection and diversion (to one side or the other, as desired) from retaining walls.

It is yet another object of the present invention to provide water collection pans which are nestable for compact packing to reduce storage volumes and shipping costs.

In carrying out the above and other objects, the drainage system of the present invention includes a plurality of water collection pans which may be quickly inserted in the interior cavities of each of the blocks over the length of a selected block wall course for collecting water drained through the cores of the upper courses and directing the water to the exterior of the block wall through an adjacent head joint or bed joint, depending on the type of block.

One embodiment of the collection pans utilized in the system for blocks (such as bond beam, lintel, or knock-out blocks) wherein the blocks include an interior cavity and the endwalls (or ends) of the block are open at the upper portion thereof, the pan includes the collector portion for positioning in the interior cavity of the block and extending across substantially the entire length of the interior cavity, the front and rear edges of the collector portion each including a flange extending generally horizontally to contact the top surface of the block adjacent the interior cavity, and a drainage channel extending outward from the collector portion past the endwall of the block into the head joint between the block and an adjacent block.

Another embodiment of the water collection pan designed for use with standard masonry units having one or more vertically extending cores bounded by endwalls which extend to the top surface of the block includes a collector portion for positioning in the core of the block, each of the front and rear edges including a flange extending generally horizontally from the edge to contact the top surface of the block adjacent the core, and a drainage channel extending downward from an opening in the collector portion through the core toward the front wall of the block and extending below the block so that the end of the drainage channel may be positioned in the bed joint below the block.

The water collection pans may be fabricated from any water impervious, corrosion resistant construction material, such as molded plastic, sheet metal, or other corrosion resistant water impervious material suitable for inexpensive mass production, as well as effective water collection and diversion in unit masonry wall systems.

The water collection pans are also preferably designed so that they can be inexpensively molded and, wherever possible, nestable with each other for compact storage and shipment.

These and other objects, features, and advantages of the present invention are readily apparent from the following detailed description of the best mode for carrying out the invention when taken in connection with the accompanying drawings.

BRIEF DESCRIPTION OF THE DRAWINGS

FIG. 2 is a perspective view of a water collection pan of the present invention installed in a bond beam and lintel block;

FIG. 3 is an enlarged perspective of the overlapping flange at one end of the collection pan;

FIG. 4 is an enlarged partial perspective view of the vertical flange at the other end of the collection pan shown in FIG. 2;

FIG. 6 is an embodiment of a water collection pan which may be used in the system of FIG. 5;

BEST MODE FOR CARRYING OUT THE INVENTION

Figure 1:
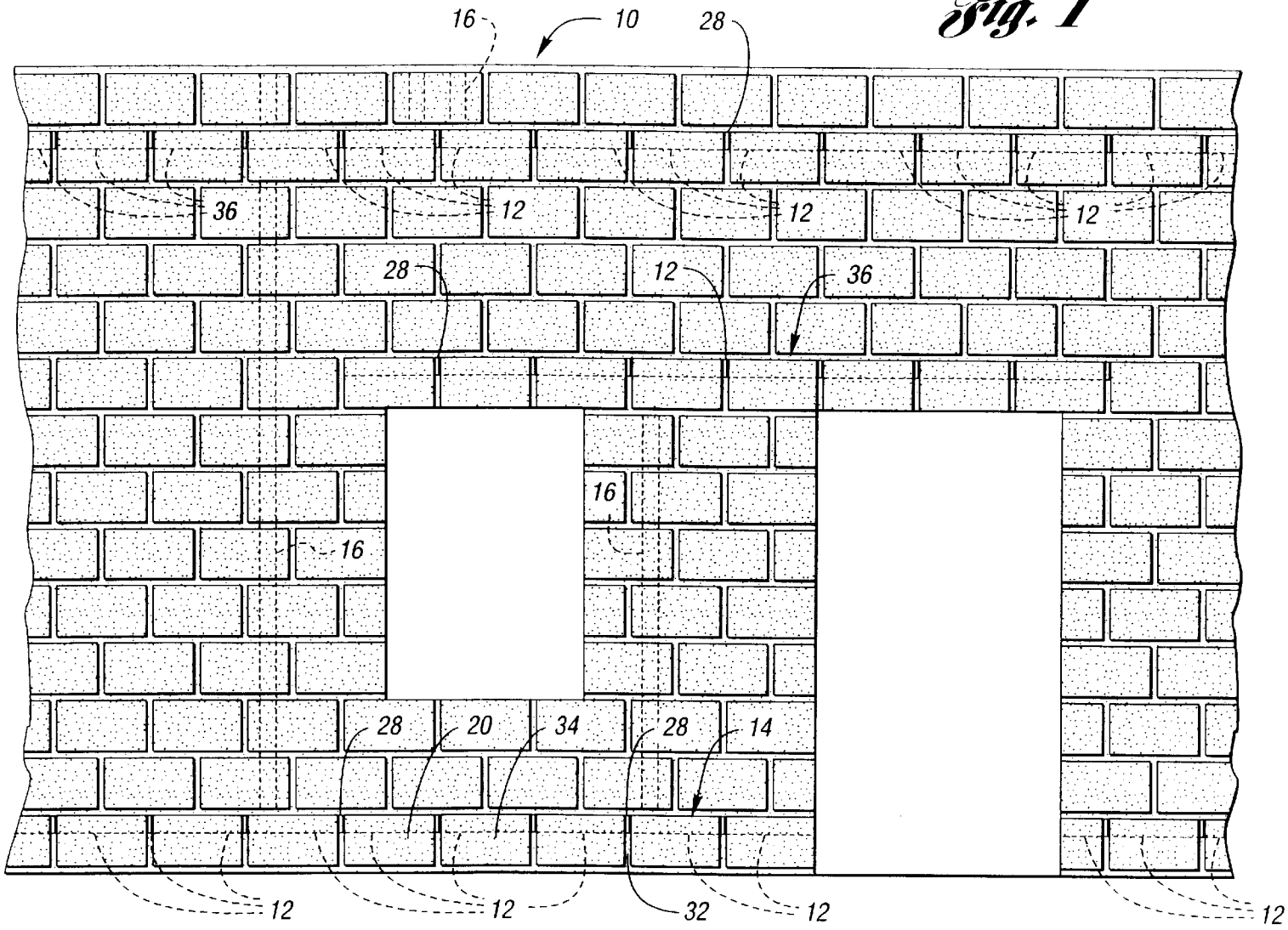
FIG. 1 is a front view of a typical exterior elevation of a masonry block wall employing the drainage system of the present invention in bond beam and lintel courses of the wall.

Referring to FIG. 1 of the drawings, the masonry block wall drainage system of the present invention generally indicated as 10 includes a plurality of water collection pans 12 positioned in the interior vertical cavities of a lower course 14 of the block wall for collecting water drained through the cores 16 of the upper courses and directing the water to the exterior of the block wall. In the illustrated embodiment, the water collection pans 12 (shown in FIG. 2)

include a collector portion 18 which is positioned in the interior cavity of a block 20 in the lower course 14 during installation of the wall. The front edge 22 and rear edge 22 of the collector portion each include flanges 24 and 26, respectively, which extend generally horizontally from the edges 20, 22 to rest upon the top surface of the block (and/or mortar) during installation.

It should be noted that, as used herein, "front" and "rear," "inner" and "outer," "inward" and "outward" and like adjectives are used to describe direction from the perspective of an observer facing the masonry block wall from the exterior of the building, such that front, outward, outside, and forward refer to the portion of the installed block (or installed water collection pans) that is relatively nearer the exterior side of the wall, and rear, inward, or inside refer to the surface of the block wall that is on the interior side of the building.

A drainage channel 28 extends forward from the collector portion 18 past the vertical face shell (also referred to herein as the endwall) 30 of the block so that the channel opening may be positioned in the head joint 32 between the block 20 and an adjacent block 34. When installed across the entire length of the selected course 14, the water collection pans form a drainage system which collects the water migrating through the cores 16 of the upper courses of the wall and direct the water outward through the drainage channels 28 of the water collection pans 12 to the exterior of the wall. Additional water collection pans 12 may be installed elsewhere in the wall as required, such as, for example, to facilitate drainage over window and door openings (at 36), at bond beam or lintel locations, at copings, and beneath sills, as well as at any other location where conventional flashing has heretofore been recommended.

In the embodiment of the water collection pan 12 shown in FIG. 2, the drainage channel 28 is generally U-shaped in cross section at its open end and includes a first endwall 38 adjacent the front side edge 30 of the block, and a second endwall 40 generally parallel to the first endwall and extending forward from the collector portion 18. The width of drainage channel 28 is preferably less than about ⅜ inches, and most preferably slightly less than ⅜ inches, at its widest point, so that the drainage channel fits within the standard size head joint.

The collection portion 18 is preferably sloped downward in the forward direction, as shown at 42, as well as being sloped downward in the direction towards the end of the pan 12 having the drainage channel 28, to facilitate migration of the water in the collection pan 12 toward the drainage channel 28.

The collection pan 12 may also include vertical ridges 46, 48, which extend upward from the upper surface of the block 20 at each of the ends of the pan, as well as a vertical ridge 47 likewise extending upward from the top surface of the block 20 at the edge of flange 26. Vertical ridge 47 serves to ensure that any water which flows onto the flange 26 migrates into the pan and not out of it. And, as illustrated in FIGS. 3 and 4, end flanges 46 and 48 are preferably configured to cooperate with a vertical ridge on the adjacent water collection pan to provide a mating overlap which serves to divert water away from the junction point of the pans into the collector portions 18 of either one or other of the adjacent pans.

It will be appreciated that the simple, open design of the water collection pan 12 allows for inexpensive fabrication of the pan, as well as allowing the pans to be nested within each other for compact packaging and shipment.

Figure 5:
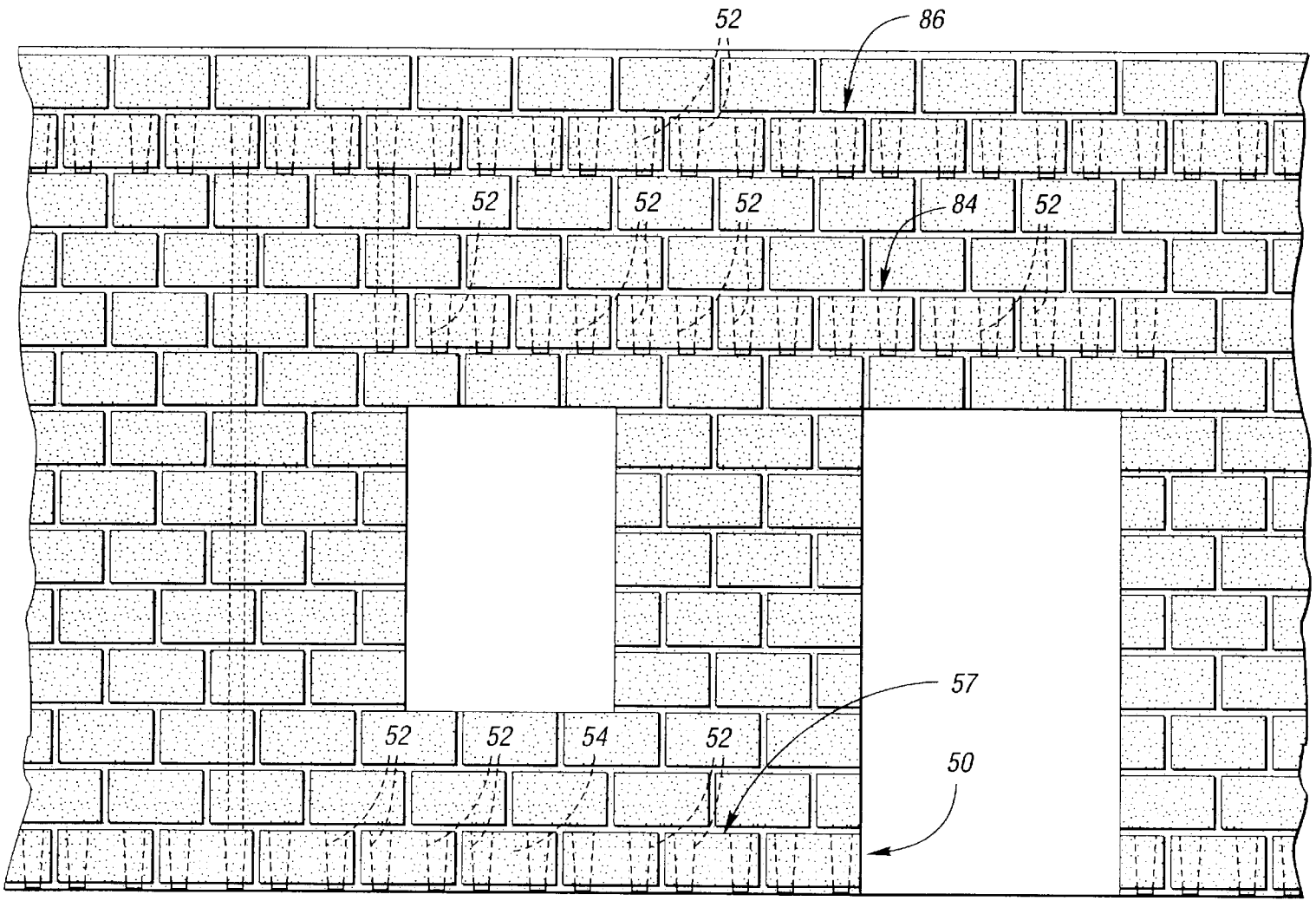
FIG. 5 is a front view of an exterior elevation of a typical masonry block wall employing a drainage system of the present invention including a plurality of water collection pans installed in a conventional block course at the base of the wall, as well as installed in a conventional block course, bond beam, or lintel.

FIGS. 5 and 6 illustrate another embodiment of the drainage system 50 which utilizes a plurality of water collection pans 52 designed to be installed in conventional concrete masonry units 54 in a selected course 57 of the block wall. In this embodiment, the water collection pan 52 includes a collector portion 56 for positioning in one of the cores 58 of the block 54. The collector portion 56 includes front and rear edges 60 and 62 from which horizontal flanges 64 and 66 extend to contact the top surface of the block 54 adjacent the core. The pan 52 also preferably includes side flanges 66, 68 which extend horizontally from the side edges 70, 72 of the collector portion 56. A drainage channel 74 extends downward through the core 58 and toward the front wall 76 of the block such that the drainage channel may be positioned in the bed joint below the block 54 during installation of the block. Again, the height of the drainage channel 74 is preferably less than about ⅜ inches, and most preferably, slightly less than ⅜ inches, so as to fit within the typical ⅜ inch thick bed joint.

The collector portion 56 is configured with surfaces which slope sufficiently to route water which has migrated downward through the cores of blocks in the upper courses of the wall above the pans 52 and direct the water out through the drainage channel 74 at the exterior of the wall. As with collector pan 12, pan 52 also preferably includes one or more vertical ridges 78, 80, and 82, extending from flanges 61, 66, and 68 to aid in providing a barrier which directs water toward the collector portion 56.

As shown in FIG. 5, pans 52 are installed in the cores of a selected lower course 57 across the entire length of the course to collect and redistribute any water within the upper courses of the block wall to the exterior of the wall. As with the previously described embodiment 10 of the drainage system, the system of FIG. 3 may also include a plurality of water collecting pans mounted in selected areas (such as at 84 and 86) at other locations in the wall for collection and drainage of water to the exterior of the block wall.

As will be appreciated by those skilled in the art, it is contemplated that the drainage system of the present invention may utilize a variety of the water collection pans disclosed herein as required by the type of masonry units found in a particular unit masonry wall system. For example, a particular selected course may include bond beam (or other open-ended) blocks along with standard blocks. Water collection pans which direct the water through drain channels in the head joint, such as collection pans 12, may be positioned over each of the interior cavities of each of the open-ended blocks, while collector pans with drainage channels positioned in the bed joint, such as pans 52, may be positioned over each of the cores of any standard blocks in the course, so that a water collection pan is positioned in each of the interior cavities across the entire length of the course, regardless of wall design, to create a continuous barrier for collection and redirection of the water.

The water collection pans of the present invention may be fabricated from any water impervious material which is formable into the desired shape, and which has corrosion resistance properties sufficient for use in construction applications. Moldable plastic, preferably injection or blow molded polyvinylchloride (PVC) may be used. Alternatively, the pans may be cut or stamped and formed from a suitable sheet metal material, such as galvanized or stainless steel or copper.

It will also be appreciated that, although the water collection pans and drainage system of the present invention are described primarily in the context of their various implementations to effect water drainage above ground, the system of the present invention is equally applicable for use in collecting and diverting water in below-grade masonry block walls. In this context, it will be appreciated that the water collection pans described herein may be oriented to divert the water from the cores inside the masonry blocks in the wall (or from a cavity in a multiple wythe system) to the interior surface or the exterior surface, as desired, depending upon the type of drainage system employed for that foundation.

Figure 7:
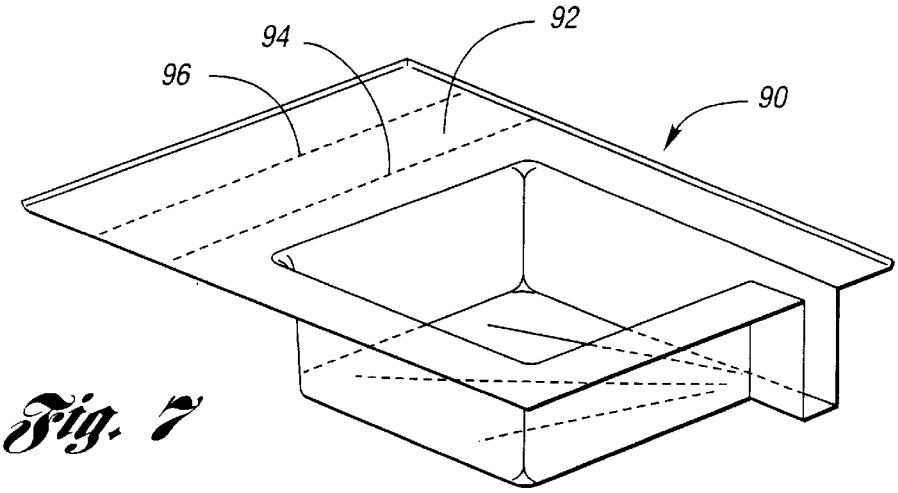
FIG. 7 is another embodiment of a water collection pan which may be utilized in an open-ended masonry unit.

FIG. 7 illustrates another embodiment of a water collection pan 90 which may be utilized in open-ended blocks. In this embodiment, the rear flange 92 is fabricated sufficiently large to facilitate use of the pan in blocks of different sizes. The flange 92 of the pan 90 may be scored at desired locations, such as at 94, 96 to allow undesired portions of the extension of the flange 92 to be snapped off in the field prior to installation, depending upon the type of block and block wall system configuration.

Figure 8:
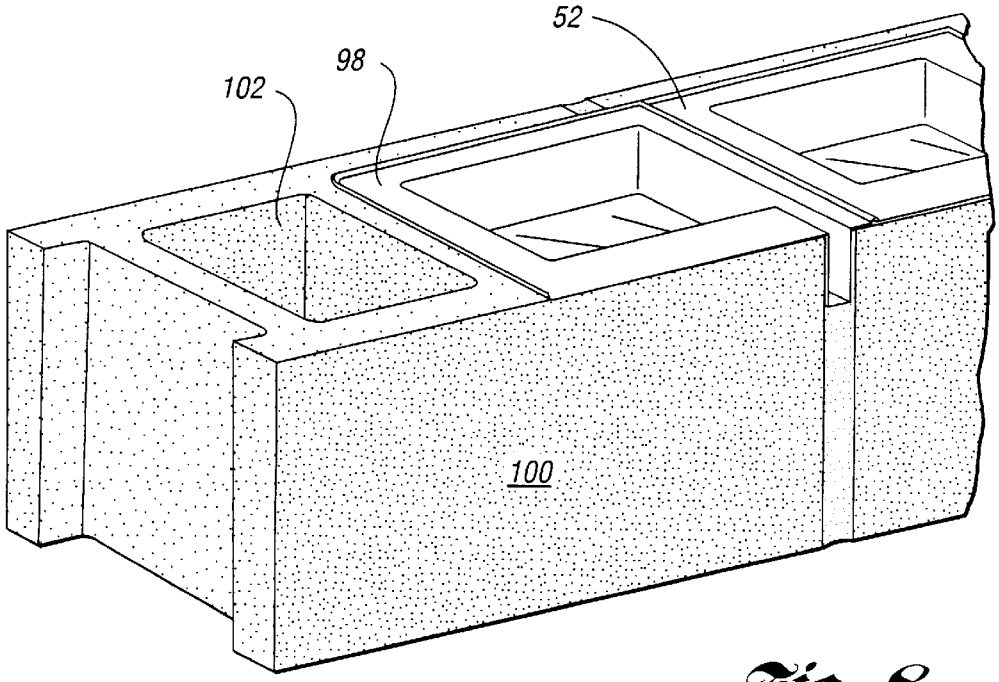
FIG. 8 is a perspective view of another embodiment of a water collection pan which may be utilized with an open-ended block.
Figure 9:
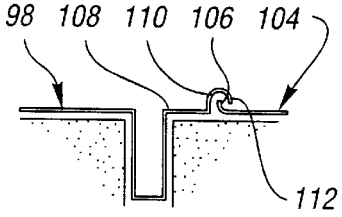
FIG. 9 is a partial front view of the adjacent edges of the water collection pans illustrated in FIG. 8.

FIGS. 8 and 9 illustrate another embodiment of a water collection pan 98 which may be used on an open-ended (or "A-shaped") block 100. In this example, another embodiment of the water collection pan, such as pan 52 (shown in FIG. 6), could be installed in core 102 of the block 100 to construct a drainage system including these type of open-ended blocks.

In this embodiment, the flange on one side of the adjacent collection pan 104 includes a generally vertical ridge 106 which is directed generally upward from the flange, while the side flange 108 of collection pan 98 includes a two-sided ridge 110 which, viewed in cross section, points generally upward from the edge of the flange 108 then downward (at 112) toward the top surface of the block so as to provide a mating overlap with the adjacent collection pan. With this design, water which drains downward at the junction of the collection pans 98, 104 will be diverted away from the junction point of the pans.

Figure 10:
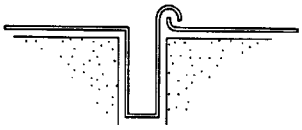
FIG. 10 is a partial front view of the adjacent edges of two alternative embodiment water collection pans.
Figure 11:
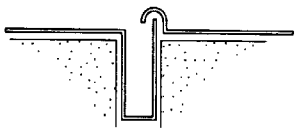
FIG. 11 is a partial front view of the adjacent edges of two other embodiments of water collection pans.
Figure 12:
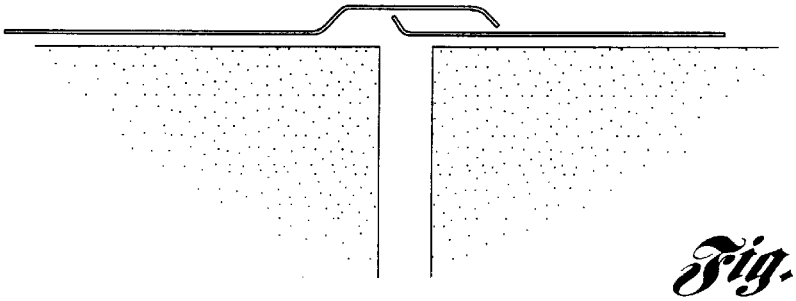
FIG. 12 is a partial front view of the adjacent edges of two alternative embodiment water collection pans.

FIGS. 10, 11, and 12 show other embodiments of ridges which may be employed on any of the designs of the water collection pans of the present invention to effect a mating overlap of adjacent pans. As will be appreciated by those skilled in the art, it is preferable that the ridges at the side edges of the water collection pans are designed so that a mating overlap is obtained between all of the adjacent pans in a selected course, regardless of what type of pan might be utilized at each location in the course.

Figure 25:
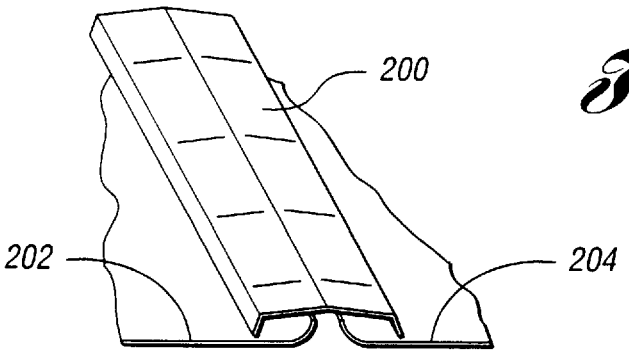
FIG. 25 is a partial perspective view of one embodiment of a bridge which may be utilized with the water collection pans.
Figure 26:
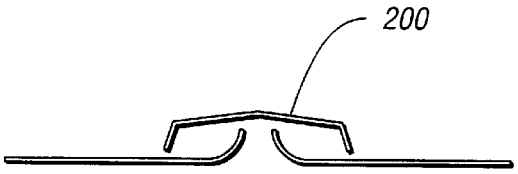
FIG. 26 is an end view of the bridge and collection pans shown in FIG. 25.
Figure 27:
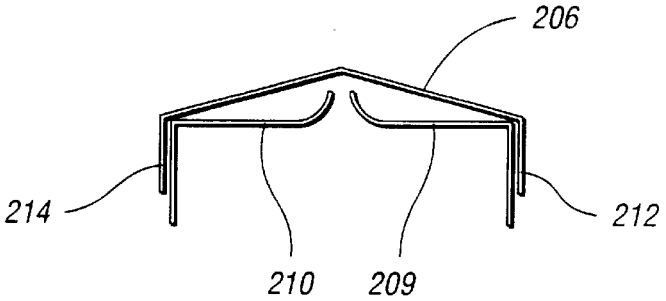
FIG. 27 is an end view of another embodiment of a bridge which may be employed with the water collection pans.
Figure 28:
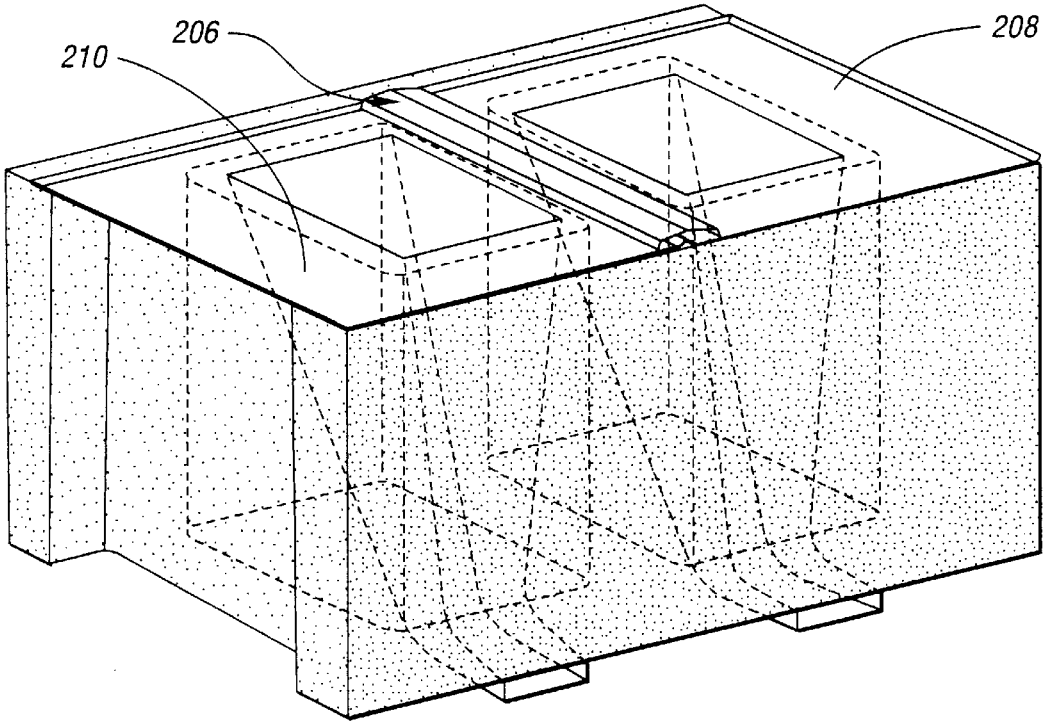
FIG. 28 is a partial perspective view of the bridge of FIG. 27.

FIGS. 25–28 illustrate alternate embodiments of bridges which may be employed on any of the designs of the water collection pans of the present invention. In the embodiment of FIGS. 25 and 26, a bridge 200 may be installed over the abutting edges of two adjacent water collection pans 202, 204 to direct water away from the space or joint between the pans. Alternatively, as illustrated in FIG. 27, a bridge 206, shaped to extend over the edges of two adjacent water collection pans 208, 210, with each end of the bridge 212, 214 extending into the collection portions of each of the pans 208, 210, respectively.

Figure 13:
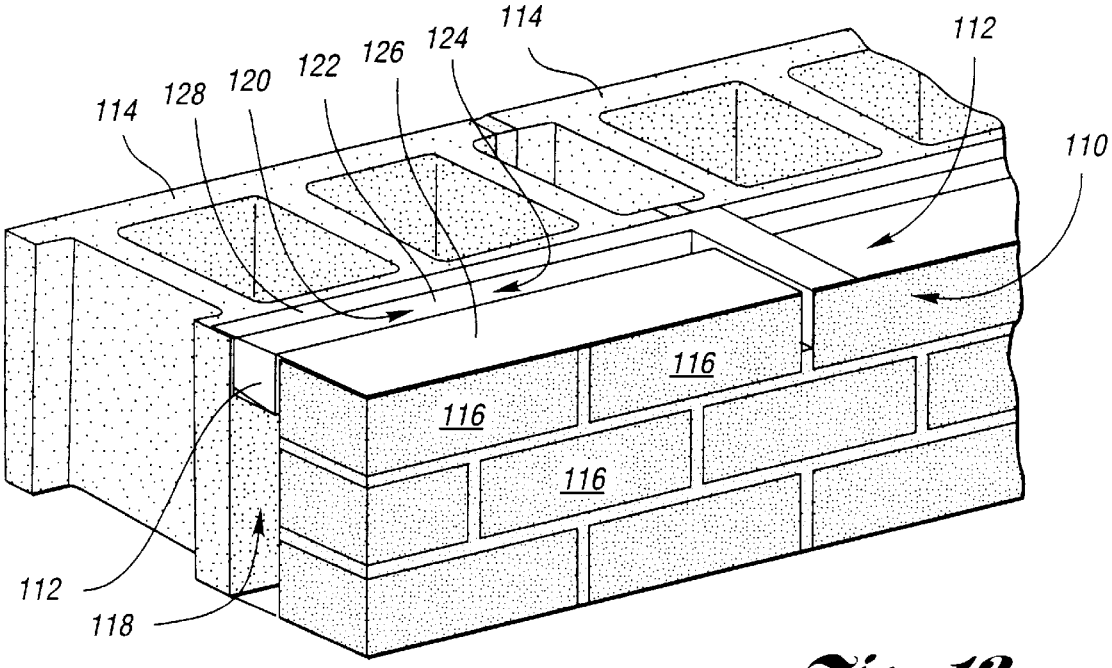
FIG. 13 is a perspective view of a masonry cavity wall system employing the drainage system of the present invention.
Figure 14:
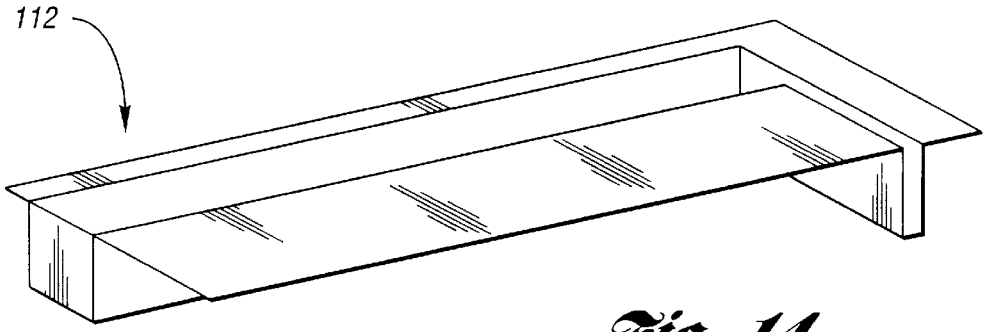
FIG. 14 is a perspective view of the water collection pan utilized in the system shown in FIG. 13.

FIGS. 13 and 14 illustrate yet another embodiment of the drainage system 110 which employs another embodiment of water collection pans 112 for installation in a masonry cavity wall system including a wythe of masonry blocks 114, and a wythe of bricks 116 separated by a cavity 118. In this embodiment, the water collection pan 112 includes a collector portion 120 shaped for positioning in the cavity 118 between the bricks 116 and the blocks 114, each of the front and rear edges 122, 124 of the collector portion having a generally horizontally extending flange 126 and 128 which contact the top surface of the bricks 116 (in the front) and the blocks 114 (in the rear) to bridge the cavity 118. If desired, water collection pans (such as pans 52 illustrated in FIG. 6) may be installed in a selected upper course of blocks 114 and the inner wall to direct water draining from inside the inner wall to the exterior surface of the blocks 114, down the cavity and into collection pans 112.

Figure 16:
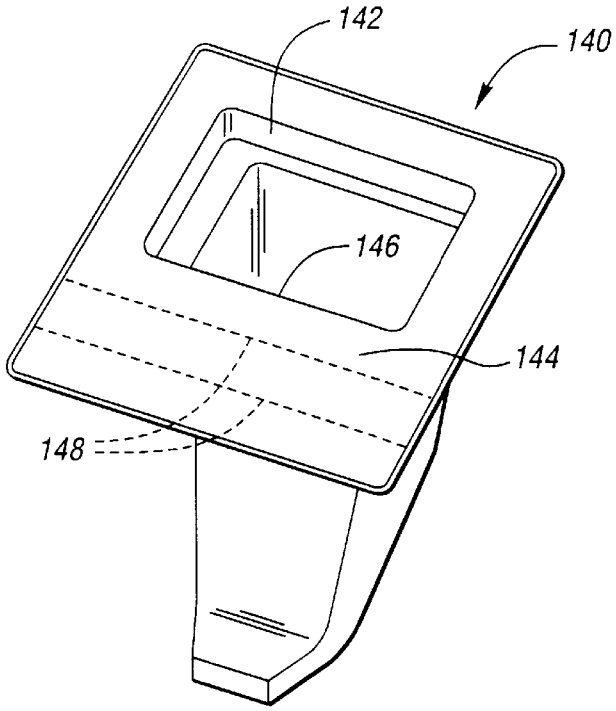
FIG. 16 is a perspective view of another embodiment of a water collection pan.
Figure 29:
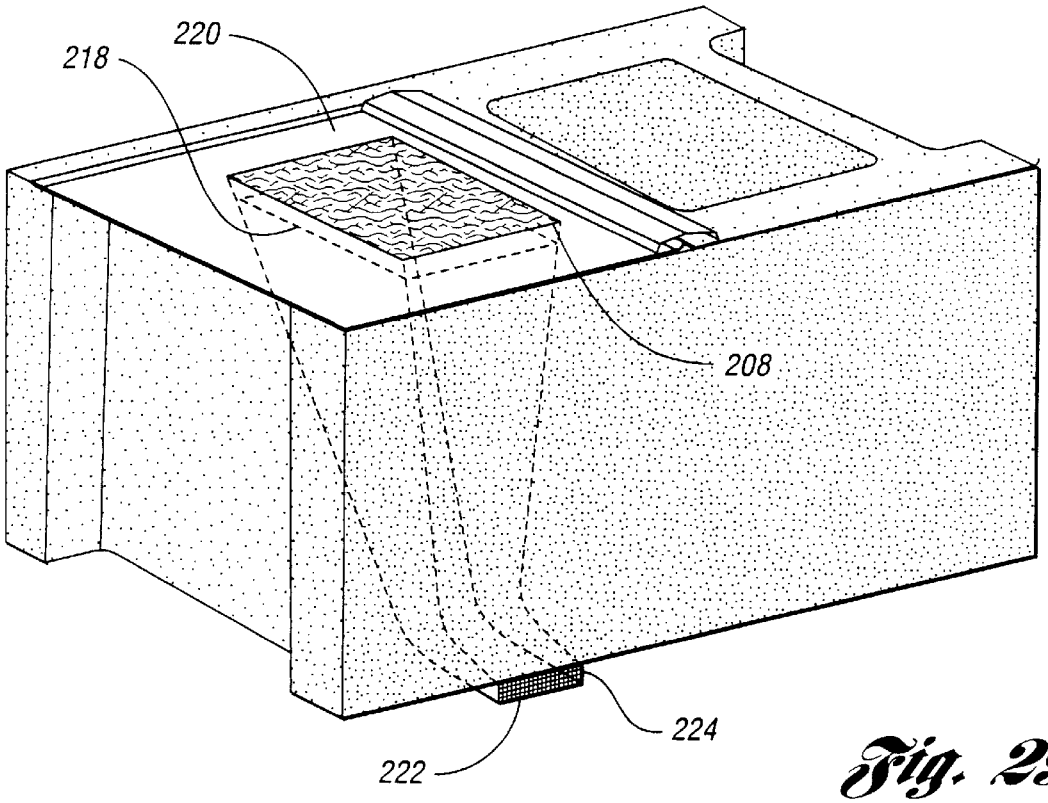
FIG. 29 is a perspective view of a masonry unit including a water collection pan and filter.
Figure 30:
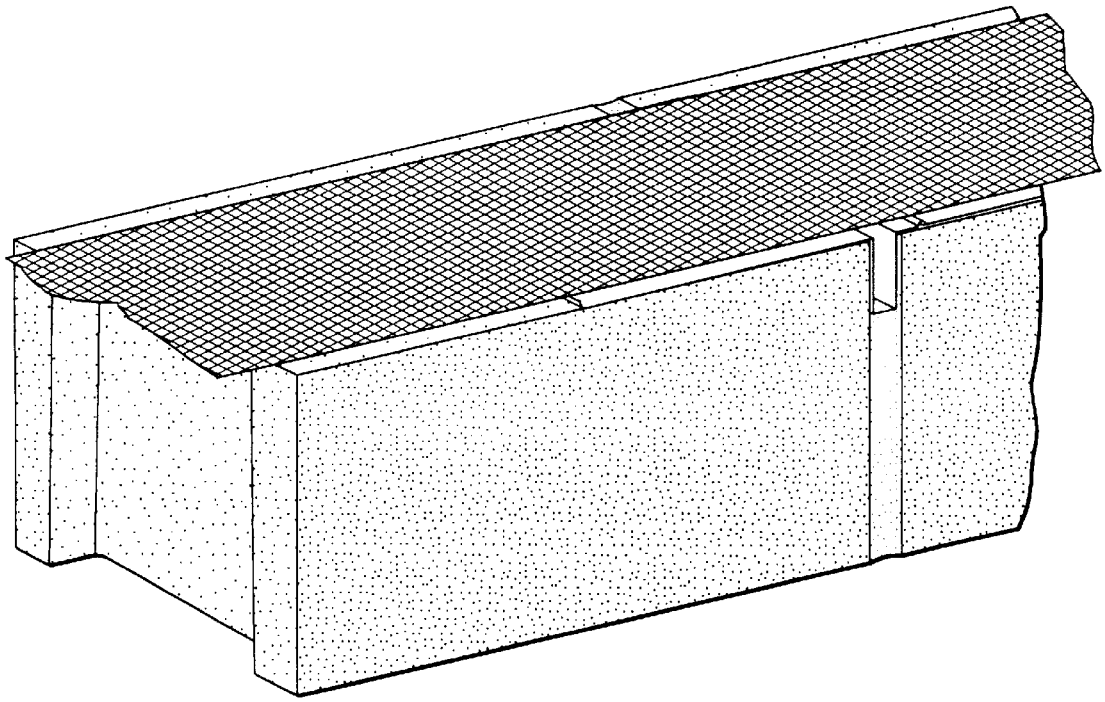
FIG. 30 is a partial perspective view of two masonry units with water collection pans and screening installed thereon.

Screening, netting, or drainable loose fills may be placed over, or in the collector portion 120, of the pans 112 to prevent excess mortar droppings, debris and/or subsequently installed insulation materials from falling into the collector portion 120 and blocking the collector portion and drainage channel of the pans. As illustrated in FIG. 29, a filter 216 of water pervious material may be cut to the appropriate size and fit within the collector portion 218 of a water pan 220. The collector portion 218 may be provided with a stepped design (such as shown in the embodiment of FIG. 16) to accommodate quick and secure installment of the filter 216 or other screening, netting or drainable loose fill materials. Alternatively, a continuous screening material may be placed over the pans, as illustrated in FIG. 30, following installation of the collection pans. It will be appreciated that any of a number of conventional screening, netting, or drainable loose fill materials may be employed for this purpose, so long as the material is suitable to block the mortar droppings or other particulate matter while allowing water to migrate therethrough into the collector portion of the collection pans.

Figure 31:
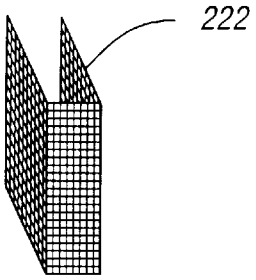
FIG. 31 is a perspective view of a screen insert which may be utilized in the drainage channel of the water collection pans.
Figure 32:
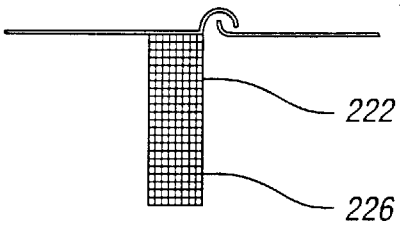
FIG. 32 is a partial front view of a water collection pan including screening over the drainage channel thereof.

Referring again to FIG. 29, as well as to FIGS. 31 and 32, screening 222 of other filtering material may likewise be installed at the drainage channel openings 224, 226 of the water collection pans to prevent animals and debris from entering through these openings.

Figure 15:
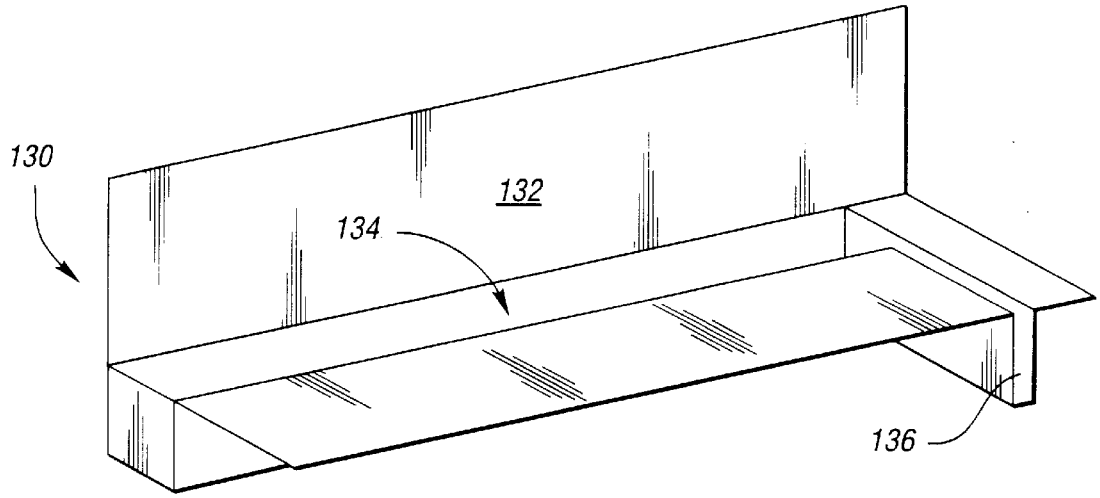
FIG. 15 is a perspective view of another embodiment of the water collection pan suitable for use in a masonry veneer system.

FIG. 15 illustrates an alternate embodiment of a water collection pan 130 designed for use in masonry veneer wall systems. This pan 130 preferably includes a generally vertical rear flange 132 which may be positioned up against the sheathing and, preferably, beneath the moisture and/or vapor barrier to direct water into the collector portion 134 and outward from the drainage channel 136 thereby providing a positive flow of the water to the exterior of the wall. The collector portion 134 is of sufficient size and shape to allow for positioning in the cavity between the sheathing and the brick wall.

FIG. 16 illustrates yet another embodiment of a water collection pan 140 wherein the walls of the collector portion 142 include a stepped reduction in size, defining a support surface upon which netting or another suitable filter may be placed as previously described. Again, the flange 144 adjacent the edge 146 of the collector portion 142 may be scored at preselected locations 148 to allow for on-site adjustment of the flange size for installation in various sized units prior to installation.

Figure 17:
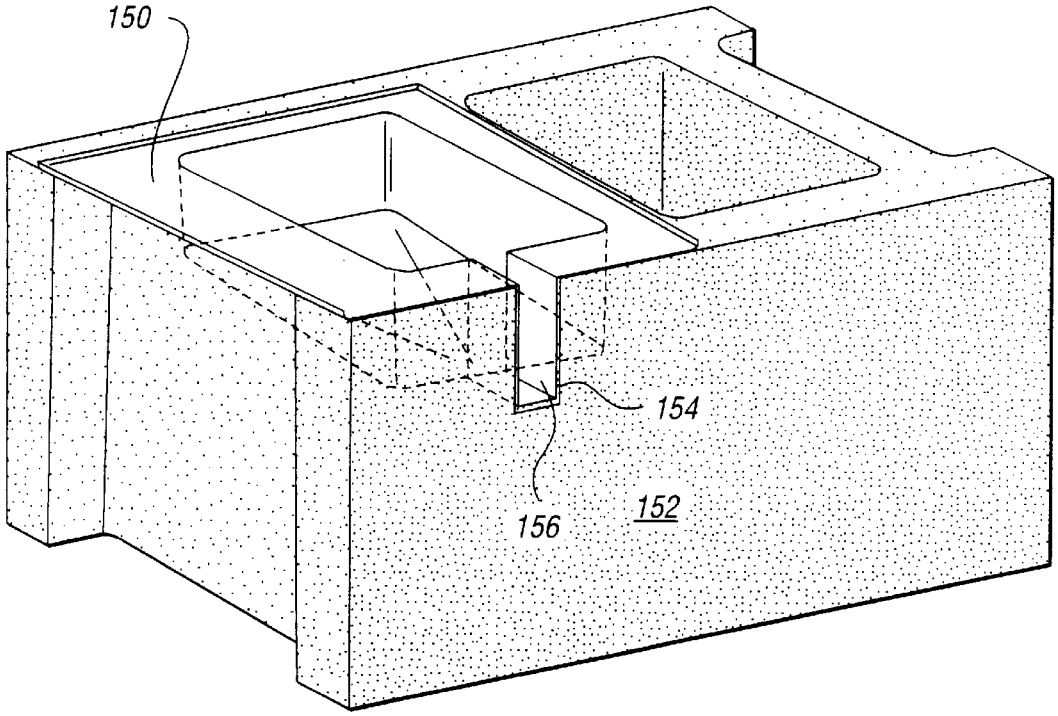
FIG. 17 is a perspective view of another embodiment of a water collection pan.
Figure 18:
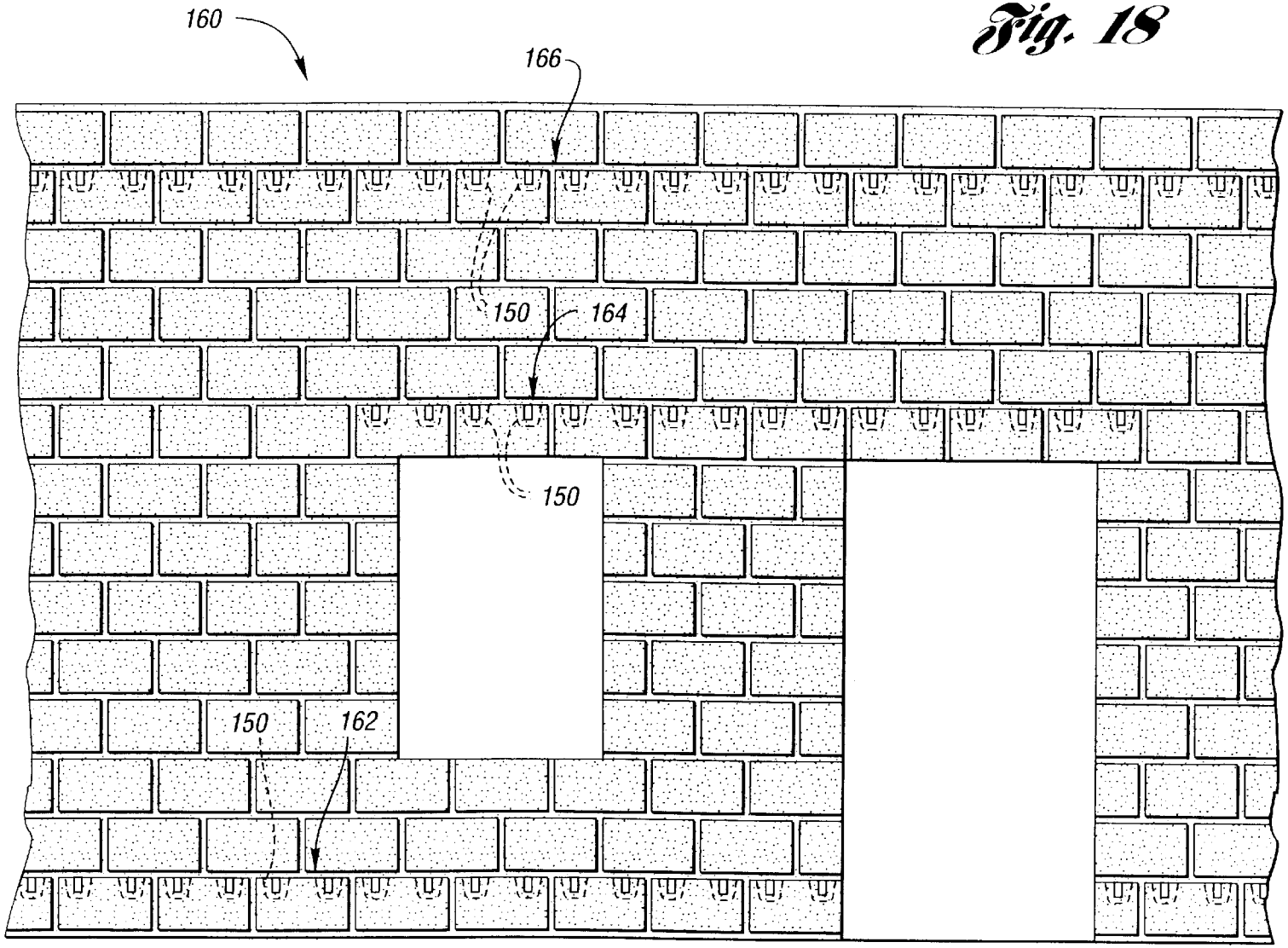
FIG. 18 is a front view of a typical exterior elevation of a masonry block wall employing a drainage system of the present invention including a plurality of water collection pans of the type illustrated in FIG. 17.
Figure 20:
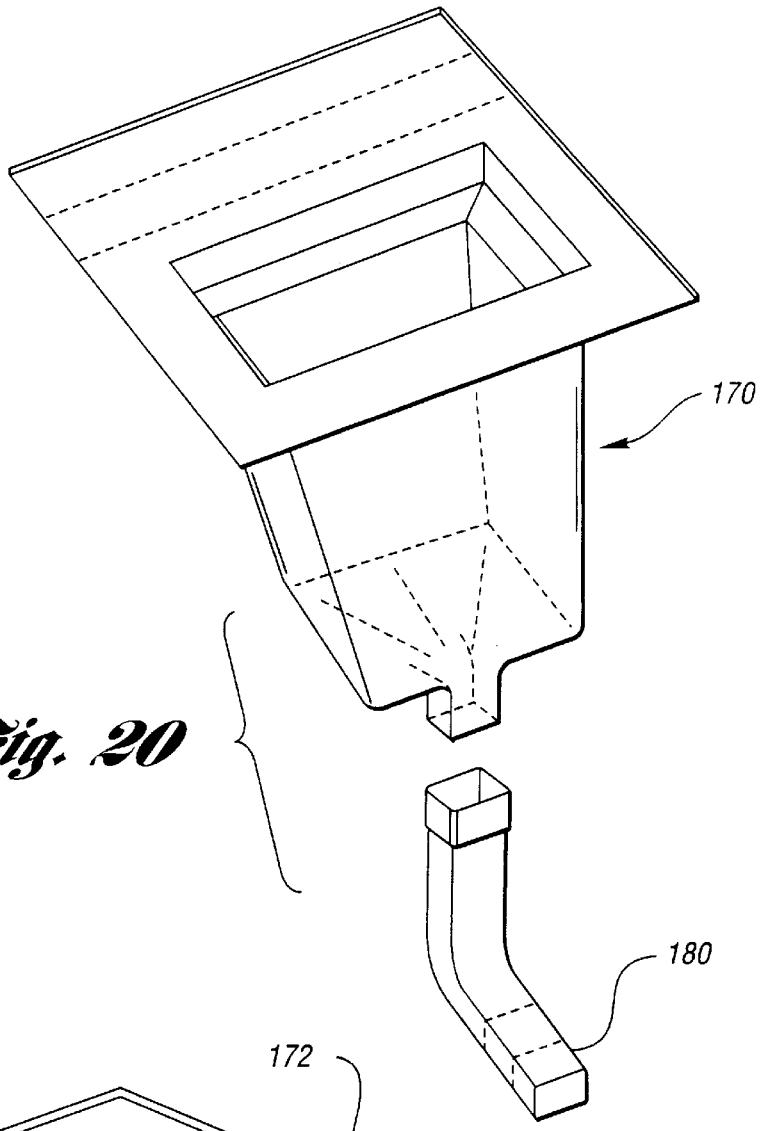
FIG. 20 is a perspective view of another embodiment of the water collection pan.
Figure 21:
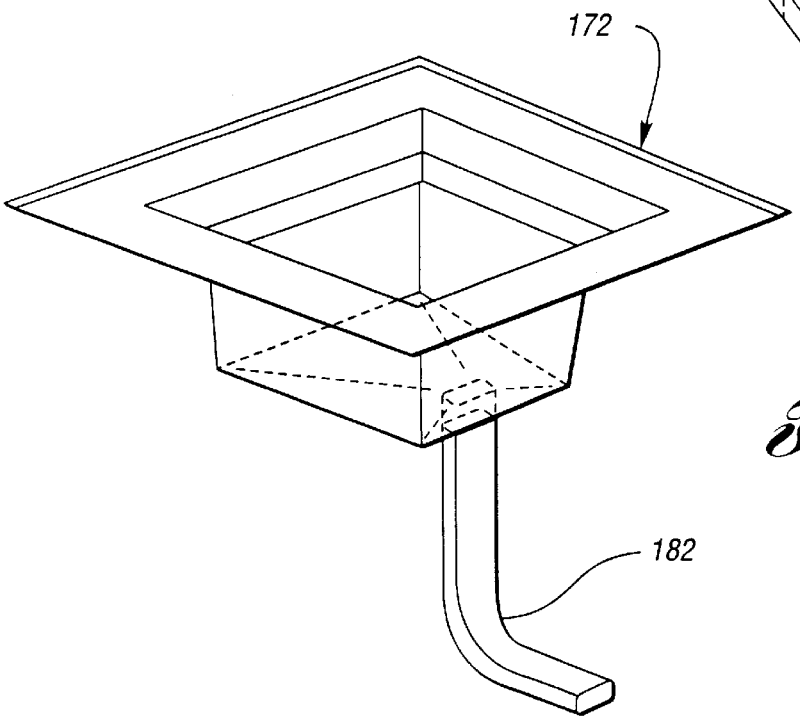
FIG. 21 is a perspective view of another embodiment of the water collection pan.
Figure 22:
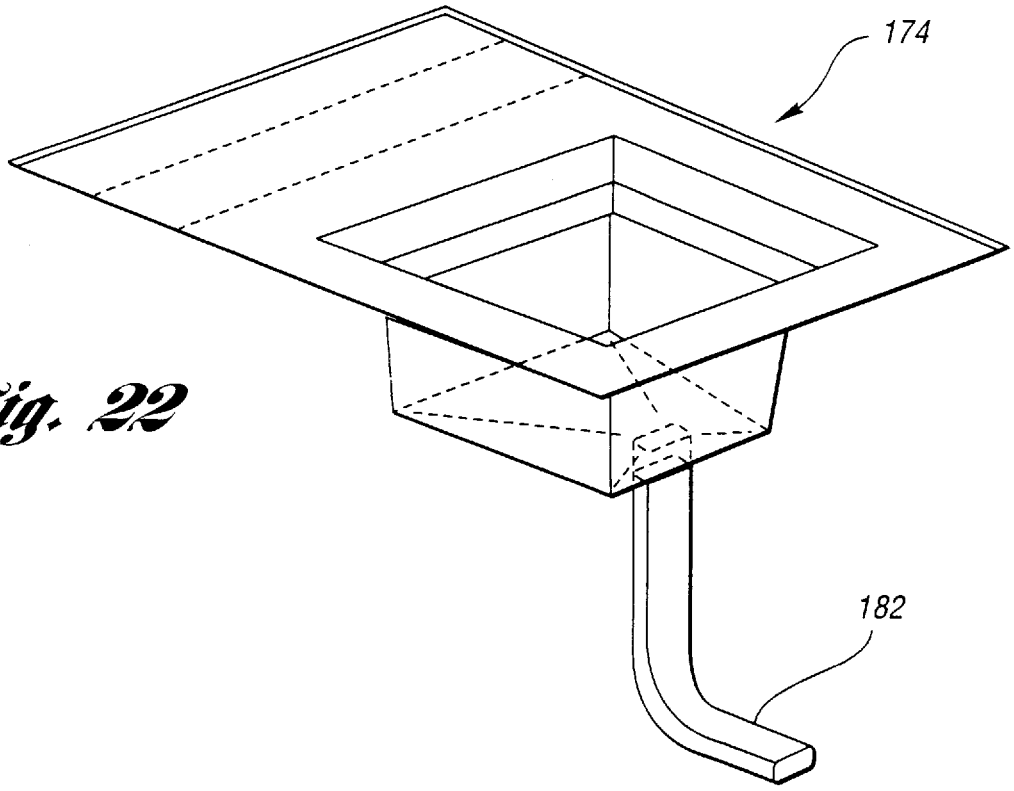
FIG. 22 is a perspective view of another embodiment of the water collection pan.
Figure 23:
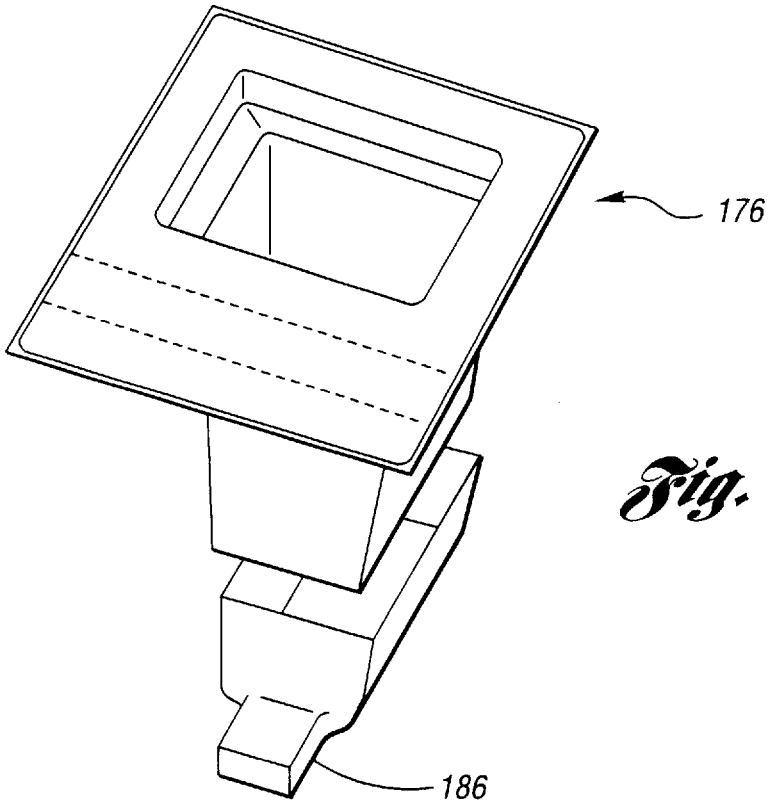
FIG. 23 is a perspective view of another embodiment of the water collection pan.
Figure 24:
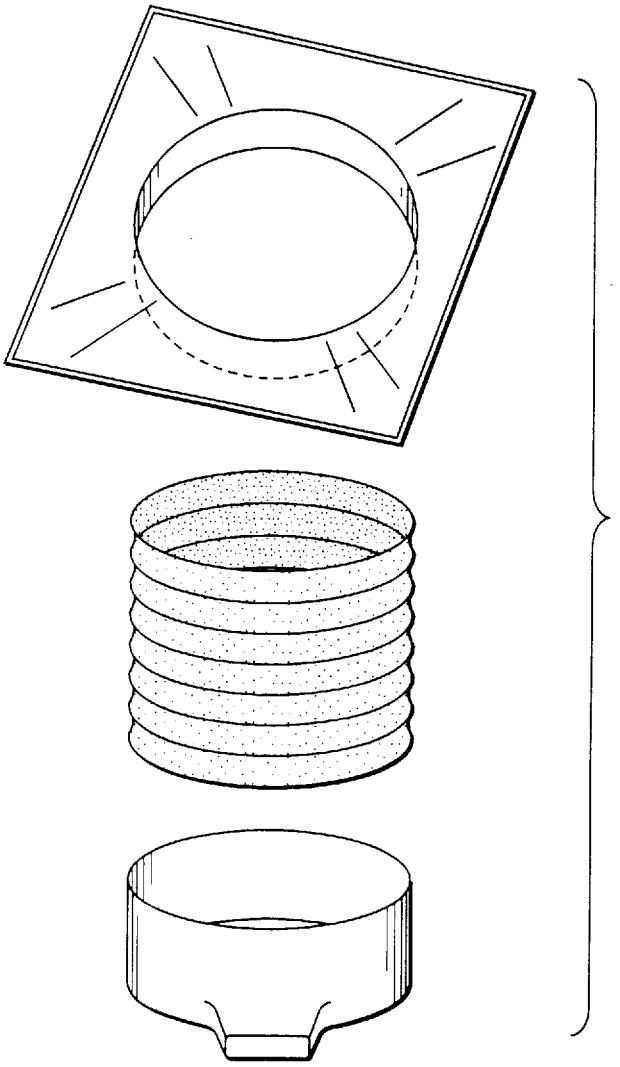
FIG. 24 is a perspective view of another embodiment of the water collection pan.

FIGS. 17 and 18 illustrate another embodiment of the water collection pan which may be installed in the core of a standard block 152 after a suitable slot 154 has been cut into the block prior to installation of the water collection pan 150, to accommodate drainage channel 156. A unit masonry wall system including a drainage system 160 employing water collection pan 150 on selected courses 162, 164, and 166 of a block wall is illustrated in FIG. 18. Again, it should be appreciated that drainage system 160 may include other embodiments of the water collection pans disclosed herein, so long as water collection pans are installed in each of the interior cavities and/or cores of the blocks in a selected course to establish an effective system for collecting water drained from upper courses, and re-direct the water, as desired, to the exterior of the wall. It will also be appreciated that water collection pan 150, as well as any of the water collection pans designed to locate the drainage channel in the bed joint below a block, may be utilized in open-ended blocks if desired.

Figure 19:
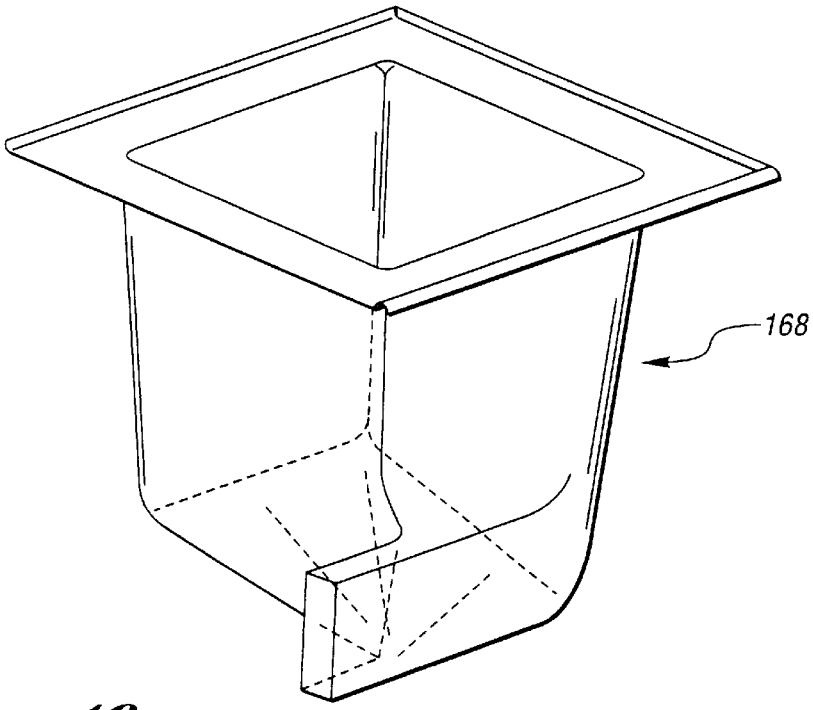
FIG. 19 is a perspective view of another embodiment of the water collection pan.

FIG. 19 illustrates another alternative embodiment of a water collection pan 168 which may be used in an open-ended block.

FIGS. 20–24 illustrate another series of alternative embodiments of water collection pans 170–178, each of which features multiple components which may be separately packed for shipment and assembled on site prior to or during installation. At each of collection pans 170–178, the drainage channels 180–188, respectively, may be attached by friction fit to the other components of the pans on site. This allows for separate fabrication of the individual components, thereby simplifying the molding (or stamping) process employed in fabricating the pan components. In addition, the larger collector portions of the pans 170–176 may be separately nested with each other for more compact packing of the components.

It will be appreciated that the water collection pans may be utilized to provide a simple flashing system for unit masonry wall systems regardless of the type of masonry unit utilized. The collection pans can be designed and installed to provide an effective drainage system, even where there are a variety of unit types (i.e., bond beam, stretch, open-ended) are utilized within the wall system. Moreover, the water collection pans may be designed so that they are inexpensive and easy to manufacture, may be shipped and stored compactly, and may be quickly sized and/or assembled at the job site.

While the best mode for carrying out the invention has been described in detail, those familiar with the art to which this invention relates will recognize various alternative designs and embodiments for practicing the invention as disclosed by the following claims.

What is claimed is:

1. A water collection pan for use in a masonry block wall having at least one upper block course and a lower block course including a plurality of blocks wherein adjacent blocks are separated by a head joint, wherein the lower block course includes at least one block having at least one interior cavity, and wherein the interior cavity opens to at least the upper portion of at least one of the endwalls of the block, the collection pan comprising:

a collector portion for positioning in the interior cavity of the block and for extending across substantially the entire length of the interior cavity, the collector portion including front and rear edges;

each of the front and rear edges including a flange extending generally horizontally from the edge for contacting the top surface of the block adjacent the interior cavity, and wherein at least one of the flanges includes a vertical ridge extending from one end thereof to aid in providing a barrier which directs water towards the collector portion of the pan; and a drainage channel extending outwardly at one side of the pan from the collector portion so as to extend past the endwall of the block into the head joint between the block and an adjacent block for draining water to the exterior of the block wall.

2. The water collection pan of claim 1 wherein the drainage channel is generally U-shaped in cross section at an open end thereof and includes a first endwall extending outward from the collector portion so as to be adjacent the front side edge of the block, and a second endwall generally parallel to the first endwall and extending outward from the collector portion so as to be adjacent the front side edge of the adjacent block.

3. The water collection pan of claim 1 wherein the collector portion includes a generally horizontal flange extending from the collector portion at an edge of the pan for contacting the top surface of the adjacent block.

4. The water collection pan of claim 1 wherein the flange extending from the rear edge of the collector portion includes a vertical projection extending upward from the flange.

5. The water collection pan of claim 1, wherein the width of the drainage channel is slightly less than about three-eighths inches.

6. The water collection pan of claim 1, wherein the collector portion includes a bottom surface which is sloped generally downward as the bottom surface extends from the rear edge to the front edge, and is sloped generally downward towards the edge of the pan nearest the drainage channel to facilitate migration of the water in the collection pan towards the drainage channel.

7. The water collection pan of claim 1, wherein at least one of the horizontal flanges is scored at desired locations for facilitating removal of undesired portions of the extension of the flange prior to installation.

8. The water collection pan of claim 1, further including end flanges located at each end of the water collection pan, wherein the end flanges are configured to cooperate with the end flanges on adjacent water collection pans to provide a mating overlap which serves to divert water away from the junction point of the pans into the collector portion of either one or the other of the adjacent water collection pans.

9. The water collection pan of claim 8, wherein one of the end flanges is a substantially vertically projecting flange and wherein the end flange on the other end of the water collection pan has a substantially inverted U-shaped cross section, whereby the vertical flange on the one edge of the pan is configured to extend upward into the opening of a U-shaped cross section of a vertical flange on the other edge of an adjacent identical water collection pan.

10. The water collection pan of claim 1, wherein the collector portion includes sidewalls extending from the front and rear edges, and wherein a generally horizontal support surface is defined in the sidewalls.

11. The water collection pan of claim 10, further including a filter conforming substantially in shape to the cross section of the collector portion immediately above the support surface, whereby the filter may be placed in the cavity and supported by the support surface.

12. The water collection pan of claim 1, further including a filter covering the collector portion of the pan to prevent excess mortar droppings, debris, or subsequently installed insulation material from falling therein.

13. The water collection pan of claim 12, wherein the filter is a screen.

14. The water collection pan of claim 12, wherein the filter is a netting material.

15. A water drainage system for a masonry block wall having at least one upper block course and a lower block course including a plurality of blocks wherein adjacent blocks are separated by a head joint, wherein each upper block course includes at least one block having at least one core, and wherein at least one block in the lower course includes at least one interior cavity which opens to at least the upper portion of at least one of the endwalls of the block, the drainage system comprising:

a plurality of water collection pans for positioning in each interior cavity of the lower course across the entire length of the lower course for collecting water drained through each core of the upper course and directing the water to the exterior of the block wall, wherein at least one of the collection pans includes, a collector portion for positioning in the interior cavity of the block and extending across substantially the entire length of the interior cavity, the collector portion including front and rear edges, each of the front and rear edges including a flange extending generally horizontally from the edge for contacting the top surface of the block adjacent the interior cavity, and wherein at least one of the flanges includes a vertical ridge extending from one end thereof to aid in providing a barrier which directs water towards the collector portion of the pan, and a drainage channel extending outward from the collector portion so as to extend past the endwall of the block into the head joint between the block and an adjacent block.

16. A water collection pan for use in a masonry cavity wall system including a first wythe of masonry units and a second wythe of other units, each having at least one upper course and a lower course including a plurality of units wherein adjacent units are separated by a head joint, the collection pan comprising:

a collector portion for positioning in the cavity between the first wythe of masonry units and the second wythe of other units for extending across the entire width of the cavity, the collector portion including front and rear edges;

each of the front and rear edges including a flange extending generally horizontally from the edge for contacting the top surface of the second wythe of other units and the top surface of the first wythe of masonry units, respectively, adjacent the cavity, and wherein at least one of the flanges includes a vertical ridge extending from one end thereof to aid in providing a barrier which directs water towards the collector portion of the pan; and a drainage channel extending outwardly from the collector portion so as to extend into the joint between one of the units in the second wythe and an adjacent masonry unit for draining water to the exterior of the wall.

17. The water collection pan of claim 16, wherein the drainage channel extends outwardly at one side of the pan.

18. The water collection pan of claim 16, wherein the collector portion includes a generally horizontal flange extending from the collector portion at an edge of the pan.

19. A water collection pan for use in a masonry block wall having at least one upper block courses, a lower block course, and a bed below the lower block course, wherein the lower block course includes a bed joint separating the blocks in the lower block course from the bed below the block, at least one block in the lower block course having at least one core, the collection pan comprising:

a collector portion for positioning in the core of the block and extending across substantially the entire length of the core, the collector portion including front and rear edges;

each of the front and rear edges including a flange extending generally horizontally from the edge for contacting the top surface of the block adjacent the core, and wherein at least one of the flanges includes a vertical ridge extending from one end thereof to aid in providing a barrier which directs water towards the collector portion of the pan; and a drainage channel extending downward from an opening in the collector portion so as to extend into the core and toward the front wall of the block into the bed joint below the block for draining water to the exterior of the block wall.

20. The water collection pan of claim 19 wherein the drainage channel has a generally rectangular shaped cross section at an open end thereof.

21. The water collection pan of claim 19 wherein the collector portion includes a generally horizontal flange extending from the collector portion at an edge of the pan for contacting the top surface of one endwall of the block.

22. The water collection pan of claim 19 wherein the flange extending from the rear edge of the collector portion includes a vertical projection extending upward from the flange.

23. The water collection of claim 19, wherein the entire collection pan is manufactured as a single integral unit.

24. The water collection pan of claim 19, wherein the collector portion is manufactured as a single integral unit and the drainage channel is manufactured as a separate unit, and wherein the drainage channel is of suitable size and shape to be friction fit in the opening in the collector portion.

25. The water collection pan of claim 19, wherein the collector portion includes an upper portion that is manufactured as a first integral component and a lower portion that is manufactured as a second integral component, and wherein the upper and lower portion are of suitable size and shape to provide for assembly by friction fit of the upper portion and the lower portion.

26. The water collection pan of claim 25, wherein the lower portion of the collector portion and the drainage channel are manufactured as a single integral component.

27. A water drainage system for a masonry block wall having at least one upper block course, a lower block course, and a bed below the lower block course, a bed joint separating the blocks in the lower block course from the bed below the block, wherein the courses each include at least one block having at least one core, the water drainage system comprising:

a plurality of water collection pans for positioning in each core of the lower course across the entire length of the lower course for collecting water drained through each core of the upper courses and for directing the water to the exterior of the block wall, wherein at least one of the collection pans includes, a collector portion for positioning in the core of one of the blocks and extending across substantially the entire length of the core, the collector portion including front and rear edges, each of the front and rear edges including a flange extending generally horizontally from the edge for contacting the top surface of the block adjacent the core, and wherein at least one of the flanges includes a vertical ridge extending from one end thereof to aid in providing a barrier which directs water towards the collector portion of the pan, and a drainage channel extending downward from an opening in the collector portion so as to extend into the core and toward the front wall of the block into the bed joint below the block for draining water to the exterior of the block wall.

28. A water collection pan for use in a masonry veneer wall system including a masonry block wall having at least one upper block course and a lower block course including a plurality of blocks wherein adjacent blocks are separated by a head joint, providing a facing for another wall and including a cavity therebetween, the collection pan comprising:

a collector portion for positioning in the cavity between the facing masonry block wall and the other wall and for extending across the entire width of the cavity between the facing masonry block wall and the other wall, the collector portion including front and rear edges;

the front edge including a flange extending generally horizontally from the edge for contacting the top surface of at least one block adjacent the cavity;

a second flange extending generally vertically from the rear edge for contacting the other wall above the cavity; and a drainage channel extending outwardly from the collector portion so as to extend past the end of a block into the head joint between the block and an adjacent block for draining water to the exterior of the block wall.

29. The water collection pan of claim 28, wherein the collector portion includes a generally horizontal flange extending from the collector portion at an edge of the pan for contacting the top surface of the adjacent block.

* * * * *